US011813227B2

(12) United States Patent
Poole

(10) Patent No.: US 11,813,227 B2
(45) Date of Patent: Nov. 14, 2023

(54) ADJUSTABLE INSULATED MEDICINE HOLDER

(71) Applicant: Kevin Taylor Poole, Winchester, KY (US)

(72) Inventor: Kevin Taylor Poole, Winchester, KY (US)

( * ) Notice: Subject to any disclaimer, the term of this patent is extended or adjusted under 35 U.S.C. 154(b) by 553 days.

(21) Appl. No.: 17/145,851

(22) Filed: Jan. 11, 2021

(65) Prior Publication Data

US 2021/0128406 A1 May 6, 2021

Related U.S. Application Data

(63) Continuation-in-part of application No. 62/894,361, filed on Aug. 30, 2019.

(51) Int. Cl.
*A61J 1/14* (2023.01)
*A61J 1/20* (2006.01)

(52) U.S. Cl.
CPC ..... *A61J 1/1418* (2015.05); *A61J 1/2096* (2013.01); *A61J 2200/50* (2013.01)

(58) Field of Classification Search
CPC .... A61J 1/1418; A61J 1/2096; A61J 2200/50; A61J 3/071; B65D 81/3876; B65D 21/086; B65D 2251/08; B65D 55/16; B65D 35/42
USPC ..... 220/8, 287, 375, 739
See application file for complete search history.

(56) References Cited

U.S. PATENT DOCUMENTS

| | | | | | |
|---|---|---|---|---|---|
| 3,734,336 | A * | 5/1973 | Rankow | B65D 25/32 | 220/592.2 |
| 4,456,134 | A * | 6/1984 | Cooper | B65D 77/06 | 215/396 |
| 5,325,988 | A * | 7/1994 | Ekern | B65D 81/3879 | 220/592.25 |
| 5,390,804 | A * | 2/1995 | Beggins | B65D 23/0885 | 220/737 |
| 5,564,583 | A * | 10/1996 | Kelley | B65D 25/287 | 220/770 |
| 10,239,662 | B2 * | 3/2019 | Park | B65D 21/086 | |
| 2013/0240549 | A1 * | 9/2013 | Beggins | B65D 81/3879 | 215/396 |
| 2021/0267394 | A1 * | 9/2021 | Nelson | B65D 81/3886 | |
| 2023/0065853 | A1 * | 3/2023 | Branch | B65D 81/3881 | |

* cited by examiner

*Primary Examiner* — James N Smalley
(74) *Attorney, Agent, or Firm* — Michael Coblenz

(57) ABSTRACT

An adjustable two piece insulated medicine bottle holder. A tubular shaped top section with an internal insulated sleeve that fits around a medicine bottle, that fits snugly within a tubular bottom section with a closed bottom. A disk of insulated material sits at the bottom of the bottom section, and the top section with the bottle and insulated material is slide down to the disk. The top section includes a threaded rim, and a cap with an center hole is screwed onto the threaded rim. The medicine vial is fully insulated, and the top of the vial is accessible through the central hole. The internal insulated sleeve varies in size to accommodate bottles of different diameters, and the top section can telescope in or out of the bottom section to accommodate bottles of different lengths.

13 Claims, 6 Drawing Sheets

ADJUSTABLE INSULATED MEDICINE HOLDER

CROSS REFERENCE TO RELATED APPLICATIONS

This application is a continuation in part of U.S. provisional application Ser. No. 62/894,361, filed on Aug. 30, 2019.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates to an insulated holder for medicine bottles that is adjustable in size to accommodate a variety of liquid medicine bottles holding temperature sensitive liquid medicine.

Description of the Related Art

Many liquid medicines are temperature sensitive. This includes a variety of vaccines, antibiotics, vitamins, inflammation/pain medication, and insulin. Insulin is one of the most common, and must be stored at between 36° F. and 46° F. (2° C. to 8° C.). One version of the recently created and approved COVID-19 vaccine, created by Pfizer, requires storage at between −80° C. and −60° C. While this may be extreme, many other vaccines and liquified medicines require temperature controlled, insulated storage and transportation. Once a temperature sensitive medicine is taken out of storage, it must be used fairly quickly or it will warm too much to be effective. To deal with this problem there are a number of thermal or insulated containers designed for distributing these temperature sensitive medicines. The use of insulated distribution containers will keep the liquid medicine cool for a much longer time than if the vial of medicine is uninsulated.

Distribution containers for holding temperature sensitive liquid medicines are well known. Most are essentially small thermos bottles or insulated containers holding the liquid medicine bottle. These are certainly useful, particularly in the medical field where a provider will have many doses of the same medicine, all of which will be held in the same size vial, and therefore only a single sized insulated container is needed. One drawback is that this means there is a need for a different sized insulated container for each different sized bottle of liquid medicine. There are quite a few users that require different sized medicine bottles. Veterinarians, particularly large animal vets must travel to the location of the animal they are treating, and may need to transport a variety of different temperature sensitive medicines that come in different sized containers. Farmers also frequently administer common medicines to their animals, and these frequently come in different sized containers. There is a need, therefore, for an insulated container for holding medicine that is adjustable in size to accommodate different sized medicine bottles.

SUMMARY OF THE INVENTION

The invention consists of an adjustable container having a top and bottom section where the top section fits into the bottom section and can move therein, telescoping out of the bottom section to increase the length of the internal space therein, or into the bottom section to decrease the length of the internal space therein. The invention also includes an insulated sleeve that fits into the internal space and can be sized to accommodate different sized medicine bottles. The use of sleeves of different sizes allows the container to hold medicine bottles of different diameter, and the use of the slidable top allows the container to hold medicine bottles of different heights. The combined use of the two allows the container to hold a variety of different sized medicine bottles. The invention also includes an outer sleeve of insulated material to provide additional insulation for the medicine.

The invention is an adjustable insulated medicine holder to hold a vial of temperature sensitive liquid medicine, consisting of an adjustable container body having a bottom section having an opened top, enclosed bottom, and bottom open interior; a top section having an opened bottom, a top open interior, and a closable top; a cap with a central hole, said cap configured to close the closable top, wherein said vial is accessed through said central hole; wherein said top section fits into said bottom open interior, and can move inwardly and outwardly in said bottom open interior to adjust the sized of a combined open interior space; a disk of insulating material sized to fit within the bottom open interior and adjacent to said enclosed bottom; an insulated sleeve disposed within said top open interior, said insulated sleeve having a central bottle opening therein configured to fit around and insulate said vial; an elastic cord attached to the top section and the bottom section to allow the sections to be pulled apart and then return to an initial position; wherein said vial of medicine is placed within said central bottle opening within said insulated sleeve, said insulated sleeve inserted into said top section open interior and said top section inserted into said bottom section open interior thereby insulating said vial. The adjustable insulated medicine holder top section and bottom section are tubular in shape, and said bottom section has an interior circumference and said top section has an exterior circumference, wherein said top section exterior circumference is less than one millimeter smaller than said bottom section interior circumference. The adjustable insulated medicine holder top section has in interior circumference and said insulated sleeve has an exterior circumference that is the same as said top section interior circumference such that said insulated sleeve fits snuggly within said top section. The elastic cord can stretch to a maximum length, and wherein further said elastic cord is attached to said top section and is configured to stretch around the enclosed bottom of the bottom section, and wherein when said top section is pulled outwardly from said bottom section the elastic cord cannot stretch far enough to allow said top section to be removed from said bottom section. The adjustable insulated medicine holder also includes an outer sleeve made from insulating material, said outer sleeve having an open interior therein wherein said adjustable insulated medicine holder fits within said outer sleeve open interior, and said outer sleeve includes a loop holder attached thereto that is configured to hold a syringe for use with medicine contained within said vial, and at least one attachment magnet attached thereto, to allow said outer sleeve to be temporarily secured on a metal surface.

The top section of the adjustable insulated medicine holder has an open bottom which has an exterior circumference and a top circumferential retention lip disposed thereon, and wherein said bottom section open top has an interior circumference and a bottom circumference retention lip disposed thereon; and wherein when said top section is inserted into said bottom section said bottom circumferential retention lip prevents said top circumferential retention lip from being removed from said bottom section, thereby preventing said top section from being easily withdrawn from said bottom section. In at least one embodiment the top section has an external wall with a multiplicity of top longitudinal ridges are disposed thereon with a space therebetween, and wherein said bottom section has an internal wall and wherein a multiplicity of bottom longitudinal ridges are disposed thereon with a space therebetween, and wherein further, when said top section is inserted into said bottom section said top longitudinal ridges fit into the space between said bottom longitudinal ridges, thereby preventing the top section from twisting within the bottom section. In another embodiment the top section has an external wall wherein there are two longitudinal channels disposed diametrically opposite each other on the external wall, and wherein said bottom section has an internal wall and wherein there are two longitudinal channels disposed diametrically opposite each other on the internal wall, and wherein further each of said top section longitudinal channels is sized and oriented to fit into each of said bottom section longitudinal channels to prevent said top section from twisting within said bottom section.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

Figure 2:
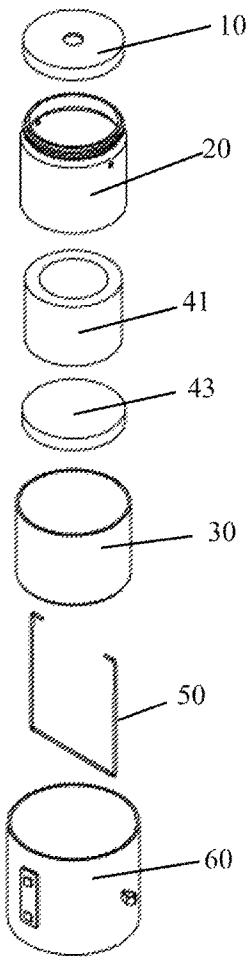
FIG. 2 is an exploded view showing the main components of the invention
Figure 1:
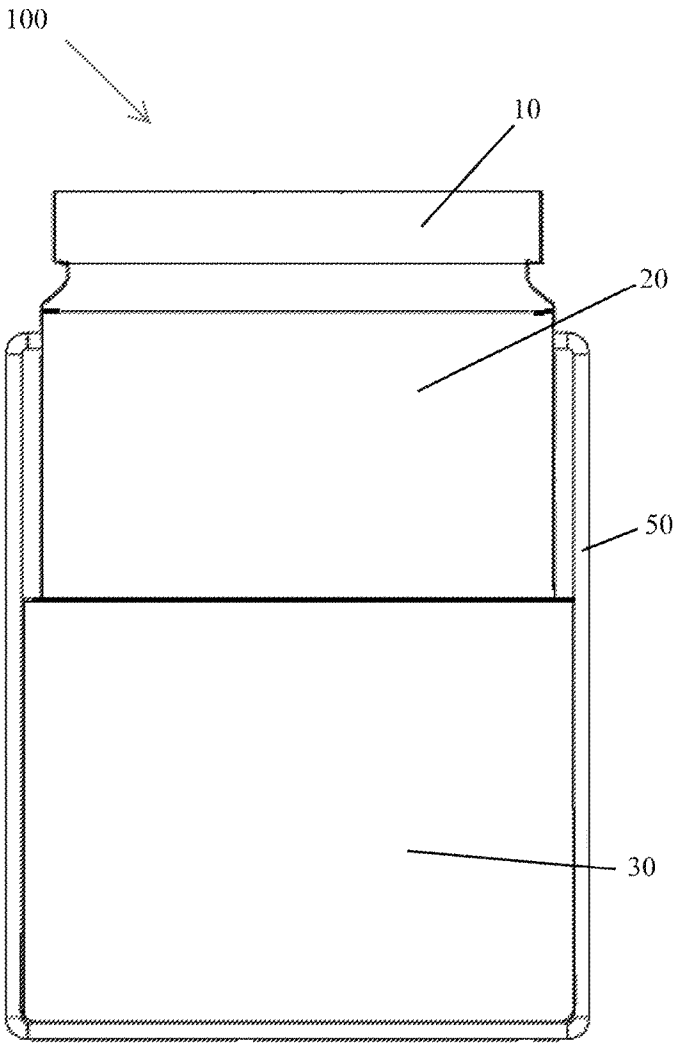
FIG. 1 is a front view of the invention with the top section in place inside the bottom section.

The present invention, an adjustable insulated medicine holder 100, is designed to hold medicine bottles or vials of temperature sensitive liquid medicine of various sizes. The adjustable insulated medicine holder 100 consists of a bottom section 30, a top section 20 that fits into and slides into and out of the bottom section 30, a cap 10 that closes off the closeable top 29 of the top section 20, said cap 10 having a center hole 13 to allow access to the top of the medicine vial held within. There is internal insulation 40 inside the bottom section 30 and top section 20 to insulate the medicine bottles, which primarily includes an insulated bottom disk 43 and an internal insulated sleeve 43 that fits around the medicine bottle. There is an elastic cord 50 that is attached to the top section 20 and bottom section 30, and allows the top section 20 to be adjustably moved or telescoped into an outwardly from the bottom section 30 and then be pulled back into place by the elastic feature of the elastic cord 40. Finally, there is an outer sleeve 60 of pliable insulating material, such as neoprene, that fits over the bottom section 30 to provide physical protection and additional insulation. FIG. 1 is a view of the top section 20 within the bottom section 30, with the cap 10 in place closing off the closeable top 29 of the top section 20, and with the elastic cord 50 inserted into the top section 20 and stretched around the bottom 35 of the bottom section 30. FIG. 2 is an exploded view showing most of the major components of the invention, from top to bottom, the cap 10, the top section 20, the internal insulated sleeve 41, the insulated bottom disk 43, the bottom section 30, the elastic cord 50 and the outside insulated sleeve 60.

Figure 3:
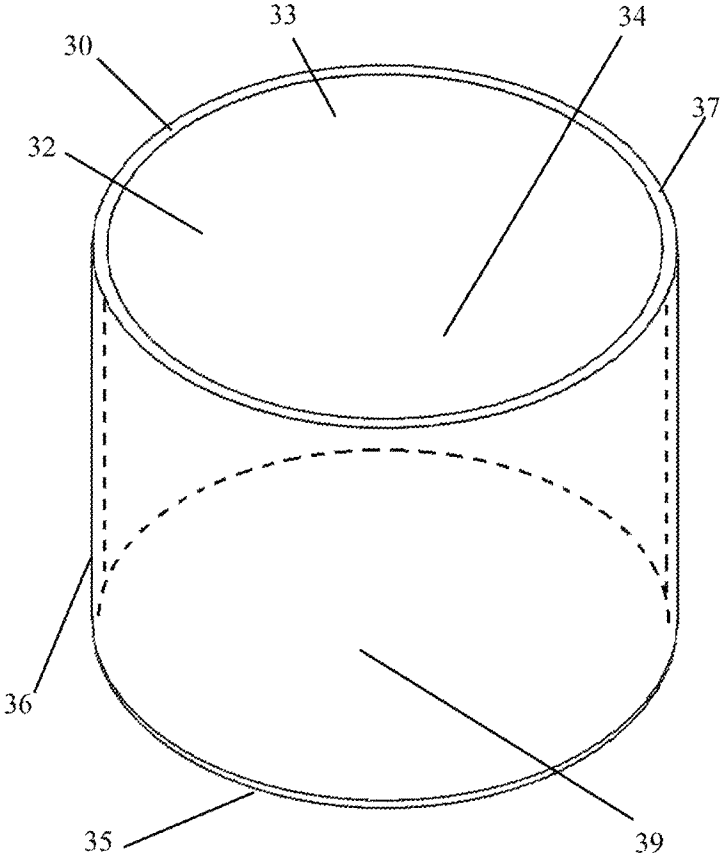
FIG. 3 is a perspective view of the bottom section.

The bottom section 30 is shown in FIG. 3. The bottom section 30 is a cylindrical tube with an open top 33, an open interior 34, and an enclosed bottom 35. Specifically, the bottom section 30 has a cylindrical wall 31 with a bottom wall inside 32 and a bottom wall outside 36, an outside bottom 35, a top rim 37, and an open interior 34 which is defined by the bottom wall inside 32 and the bottom section inside bottom 39. In the preferred embodiment the bottom section 30, as well as the top section 20, is made of molded polyethylene (PE), which is commonly used for these types of holders and devices, although polystyrene (PS) or polypropylene (PP), or other suitable molded plastic may be used.

Figure 4:
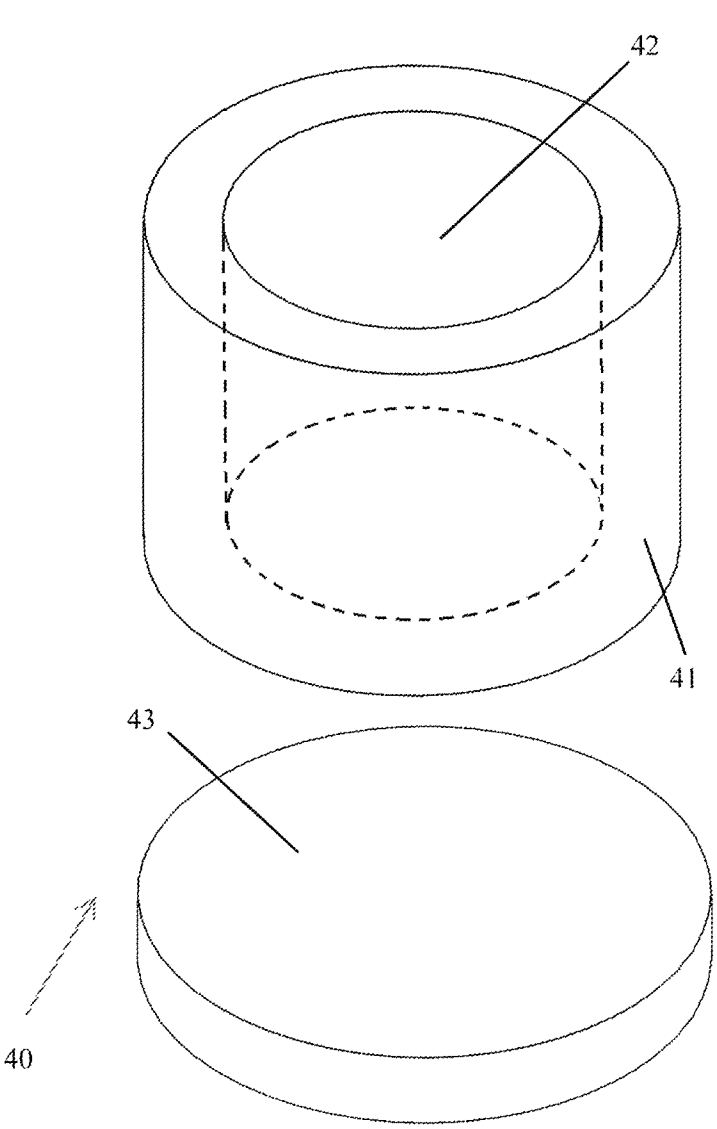
FIG. 4 is a perspective view of the internal insulated insert components.

FIG. 4 shows the interior insulation 40, which consists of an insulated bottom disk 43 and an insulated internal sleeve 41. In the preferred embodiment the interior insulation 40 is made of a light insulating material such as polystyrene, closed cell polyethylene or other suitable insulating material. In the preferred embodiment the insulated bottom disk 43 has a diameter that is just slightly smaller than the inside diameter of the bottom inside wall 32 such that the insulated bottom disc 43 can be inserted snugly into the enclosed inside bottom 39 of the bottom section 30. The insulated bottom disc 43 is inserted into the open interior 34 of the bottom section 30 and pushed down so that it rests against the inside bottom 39 of the bottom section 30, to provide insulation at the bottom of the bottom section 30. In one embodiment there is a central circular recess in the insulated bottom disc 43 that is sized to hold a medicine vial in place. In the preferred embodiment there is also an internal insulated sleeve 41 that is inserted into the open interior 34 of the bottom section. The internal insulated sleeve 41 is a cylindrical tube of insulated material, with a central bottle opening 42 sized to accommodate common sized medicine bottles. The thickness of the walls of the internal insulated sleeve 41 can vary depending upon the size of medicine bottle to be held in the adjustable insulated medicine holder 100. The inside diameter of the central bottle opening 42 is determined by the size of the medicine vial to be held. The internal diameter should be about a millimeter smaller than the outside diameter of the medicine vial so that it fits snugly and securely into the internal opening of the sleeve 43. The common insulating materials used for the insulated sleeve 41 is flexible and has give so that a bottle slightly larger than the hole can be fit in. The outside diameter of the internal insulated sleeve 41 is slightly less than the diameter of the top section inside wall 26, as described below. There will be multiple internal insulated sleeves of varying length and with varying sized central bottle openings 42 to accommodate vials of varying sizes. In one embodiment the internal insulated sleeve will be cut into to halves to more easily accommodate differing sized medicine bottles.

Figure 5:
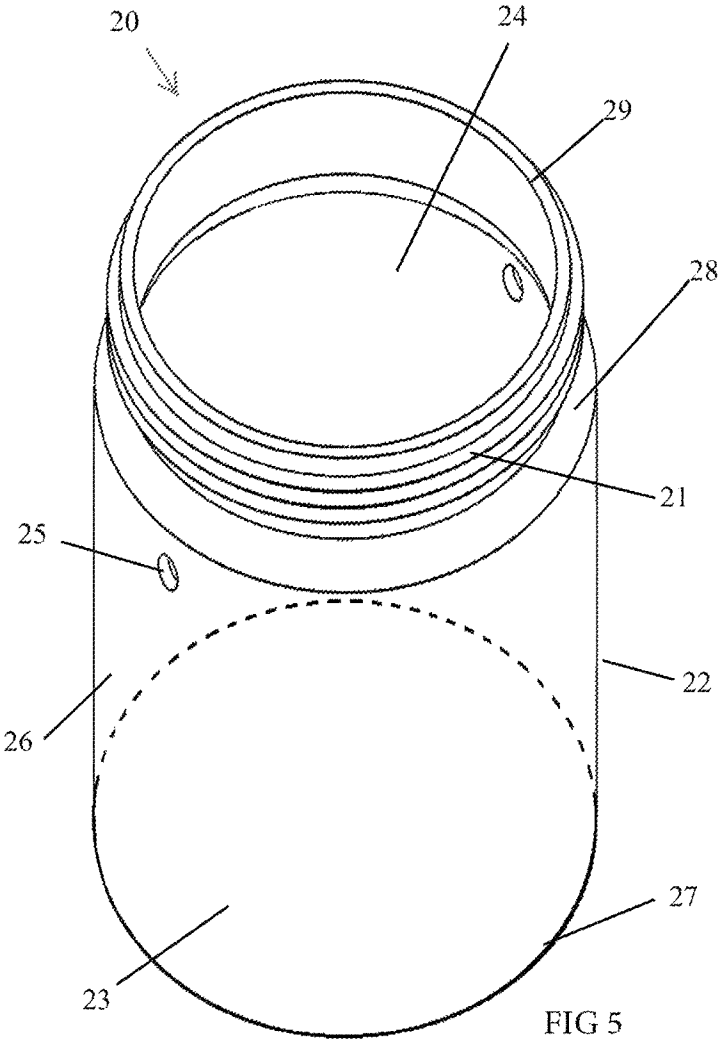
FIG. 5 is a perspective view of the top section.

The top section 20 is a cylindrical tube with inside wall 26 and an outside wall 28, wherein the cylindrical inside wall 26 forms the top section open interior 24, as shown in FIG. 5. The diameter and circumference of the top section outside wall 28 is just slightly smaller than the diameter and circumference of the bottom inside wall 32 so that the top section 20 fits into the bottom section 30. This allows the top section 20 to slide into and out of, or nearly out of, the bottom section 30, which increases or decreases the overall length of the holder 100 and the overall length of the interior space that holds varying sized medicine vials. In the preferred embodiment the difference between the circumference of the top section outside wall 28 and bottom section inside wall 32 is less than one millimeter and preferably a fraction of a millimeter so that there is enough space between the two so that the sections slide, but so that the walls are close enough to prevent heat flow or heat transfer through the open space between the walls. The outside diameter of the internal insulated sleeve 41 is slightly smaller than the outside diameter of the top section inside wall 26, so that the top section 30 can also move up and down around the internal insulated sleeve 41. This means that when the internal insulated sleeve 41 is in place inside the bottom section 30 there is a circumferential gap between the internal insulated sleeve 41 and the inside wall 32 of the bottom section. The top section 20 moves within that circumferential gap.

Figure 6:
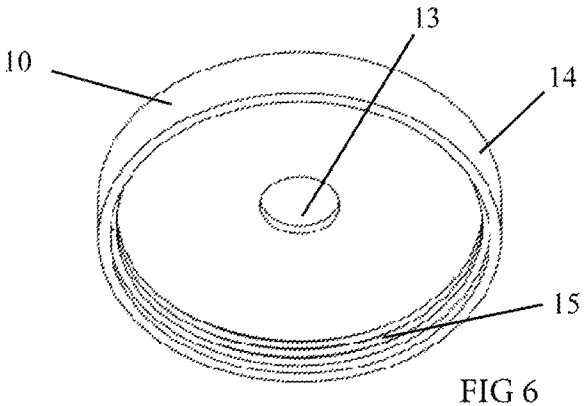
FIG. 6 is a perspective view of the cap.

There is a closeable top 29 with an externally threaded rim 21 at the top of the top section 20. In one embodiment there is a neck 28, where the top section tapers inward to a smaller diameter so that the threaded rim 21 has a smaller diameter than the outside wall 22 of the top section 20. This allows the outer edge 14 of the cap 10 to have the same diameter as the outer wall of the top section 20 so that the outside of the adjustable insulated medicine holder 100 is uniform. There is a top cap 10, shown in FIG. 6, with an internally threaded inside rim 15 that is sized and configured to threadedly attach to the externally threaded rim 21 of the top section. This allows the cap 10 to be removably attached to the top section 20, and close the closeable top 29. There is a center hole 13 in the center of the top cap 10. The center hole 13 is sized to allow access to the top of the medicine vials inserted into the adjustable insulated medicine holder 100. As is well known, most, though not all, liquid medicine bottles, or vials, have a rubber vial stopper across the top opening which allows a user to insert a syringe into the vial and withdraw the liquid medicine without the medicine spilling. Most medicine vials have a standard sized top and the center hole 13 is can be precisely this size. The three most common sizes for the vial stopper are 13 mm, 20 mm, and 30 mm. In one embodiment there is an insulated collar 47 that is a ring shaped piece of insulation that fits around the top of the medicine vial to protect the opening.

Figure 7:
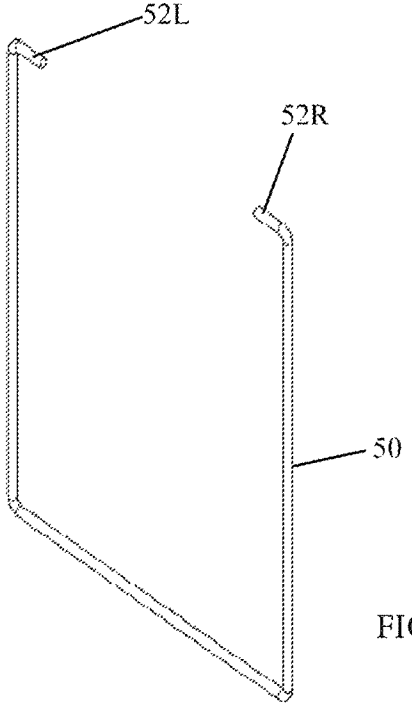
FIG. 7 is a perspective view of the elastic cord.
Figure 8:
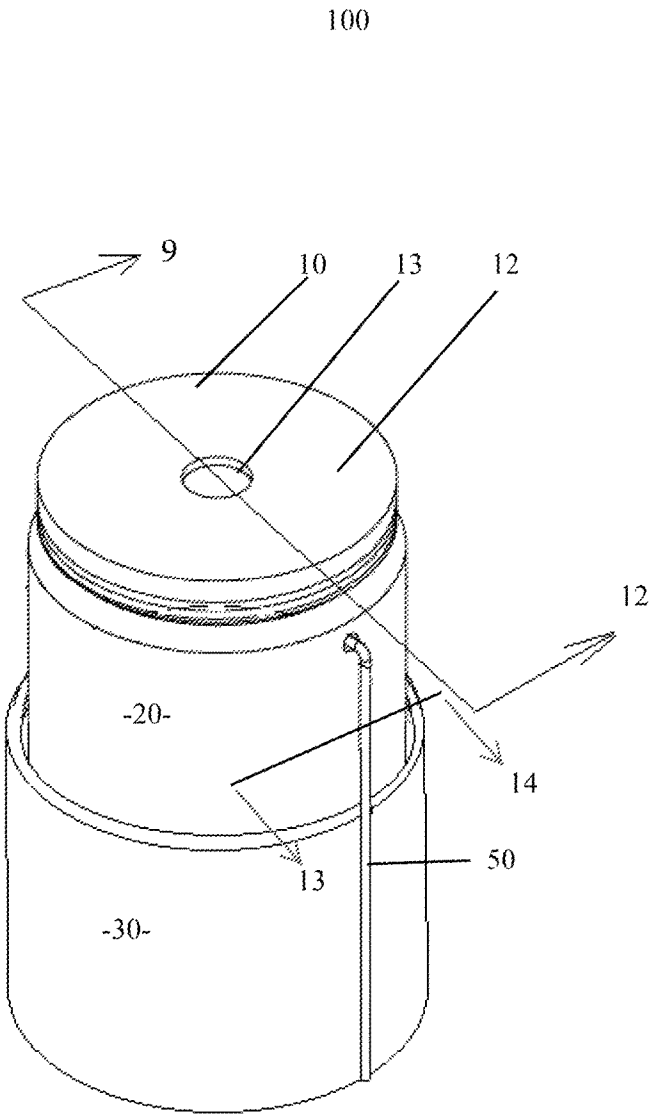
FIG. 8 is a perspective view of the invention with the top section in place in the bottom section.

There is an open bottom 23 at the bottom of the top section 20 so that the top section 20 can fit over the internal insulated sleeve 41 and move into and out of the bottom section 30. There are two bungee holes 25 near the threaded rim 21 at the top of the top section 20. The bungee holes 25 extend fully through the body 22 of the top section 20. An elastic cord 50, shown in FIG. 7, is inserted through the bungee holes 25 and secured. In one embodiment the ends 52L & 52R of the elastic cord 50 are simply tied and the knot on the inside of the bungee hole 25 secures the elastic cord 50 in place. The ends 52L & 52R of the elastic cord can be secured in any suitable manner, including but not limited to gluing. The elastic cord 50 extends under the bottom of the top section 30 and the bottom 35 of the bottom section 30, as shown in FIG. 1 and FIG. 8. This movably secures the top section 20 in place within the bottom section 30 and allows the top section 20 to be telescoped inwardly and outwardly. Because the elastic cord 50 is stretchable, the top section 20 can be pulled outwardly from the bottom section 30 to increase the interior space within both components. In the preferred embodiment the elastic cord 50 is secured to the bottom of the bottom section 30 so that it does not slide off and become disconnected. In one embodiment it is secured simply by gluing. The elastic cord 50 is stretchable, and in one embodiment is a rubber band, and in another embodiment is a bungee cord. The value of a bungee cord over a standard rubber band is that a bungee cord typically has an internal cord that limits the stretch length of the bungee cord. This is important in this invention because when the length of the elastic cord 50 is set appropriately it allows the top section 20 to move outwardly from the bottom section 30, but not so far that it becomes disconnected.

Figure 9:
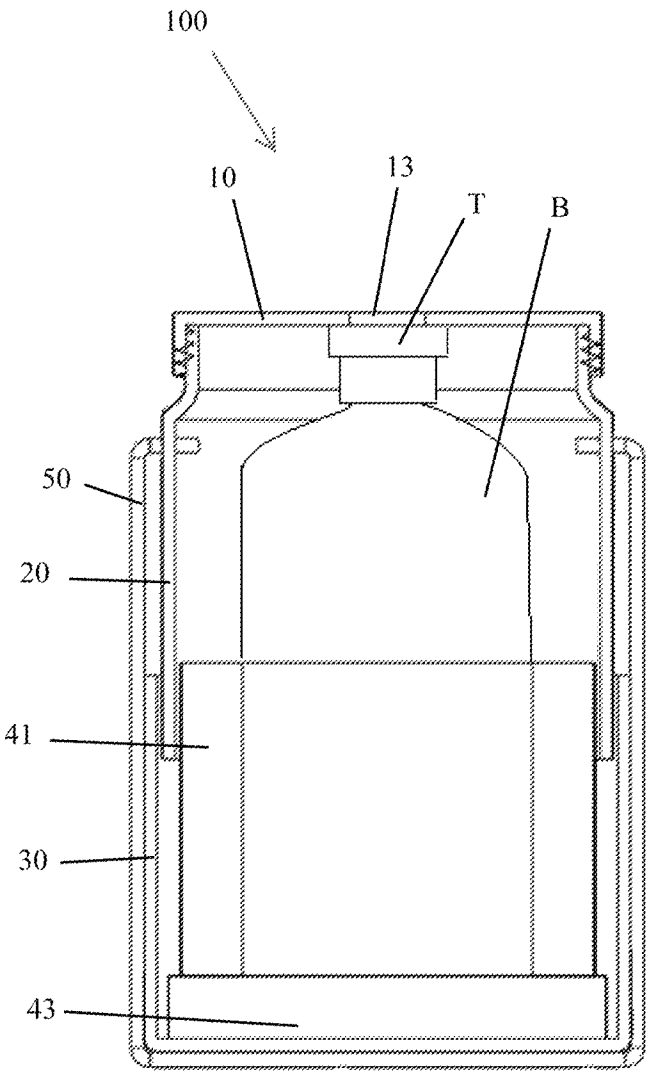
FIG. 9 is a cut-away view showing the internal space and a representative medicine vial with the insulated bottom disc and internal sleeve.

FIG. 8 shows the top section 20 attached within the bottom section 30 and with the elastic cord 50 pulling the two components together. The cap 10 is attached on the top section 30. FIG. 9 is a cut away view of the same, but also showing the medicine bottle within the adjustable insulated medicine holder 100. As seen in FIG. 9, the medicine bottle B sits inside the internal insulated sleeve 41 with the top T of the medicine bottle at the center hole 13 of the cap 10. The elastic cord 50 pulls the top section 20 down into the bottom section 30.

Figure 11:
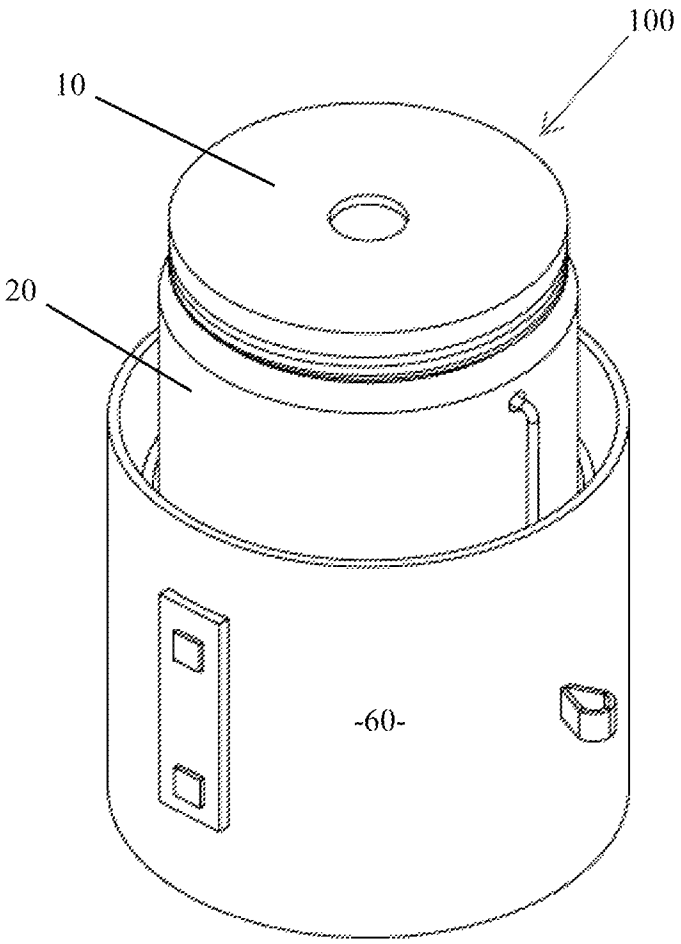
FIG. 11 is a perspective view of the invention with the outer sleeve in place.
Figure 10:
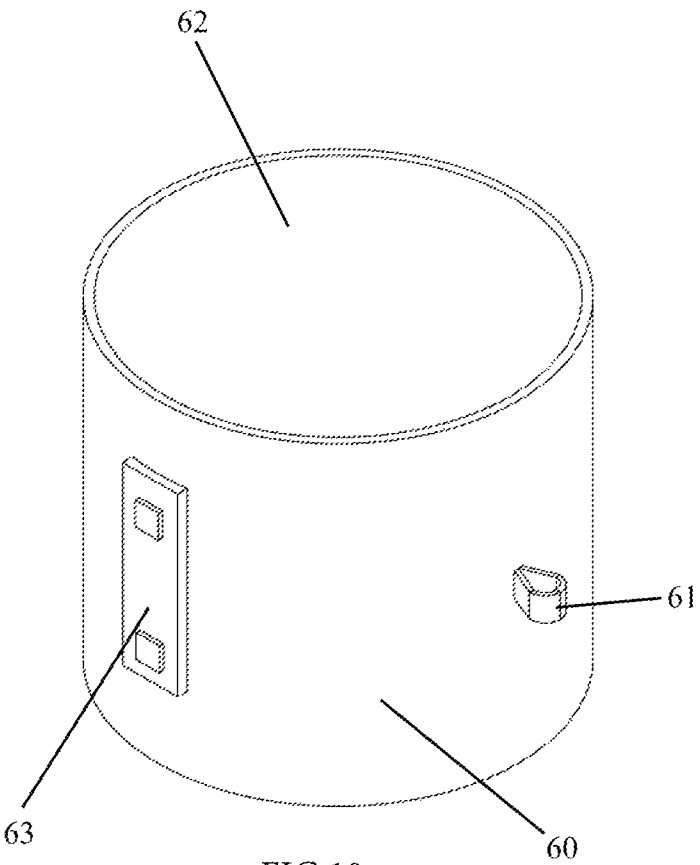
FIG. 10 is a perspective view of the outer sleeve.

There is also an outer sleeve 60 made of a soft, pliable insulated material such as neoprene, which is shown in FIG. 10. The outer sleeve 60 is a cylindrical cup made of soft pliable material. It is very similar to the common KOOZIE® or insulated sleeve holder for beverages. It is made from an insulated material and is about $1/16^{th}$ of an inch thick, though it can be thicker to provide additional insulation. The material is sewn into a cup shaped sleeve with an internal opening 62 that is sized to accommodate the bottom section 30 of the medicine holder 100. FIG. 11 shows the medicine holder 100 in the outer sleeve 60. As can be seen, the outer sleeve 60 fits firmly around the bottom section 60, and only loosely around the top section 20, which allows the top section 20 to be movable. The outer sleeve 60 also has a small loop holder 61 attached thereto. In the preferred embodiment the loop holder 61 is made of the same material as the body of the outer sleeve 60, and is a ¼ inch wide. The loop holder 61 is configured to hold a syringe, so that, when in use, the syringe is readily available. There is also an attachment magnet 63 attached to the outer sleeve 60. In the preferred embodiment the attachment magnet 63 is attached to the outer sleeve 60 by placing it in a cloth holder and sewing the holder to the outer sleeve 60. In the preferred embodiment the attachment magnet 63 is actually comprised of two small rare earth magnets, as shown in FIG. 10. The attachment magnet 63 allows the medicine holder 100 to be attached to a metal surface, like the side of a truck or tractor. It will not be uncommon for this medicine holder 100 to be used in farm or agricultural settings, and the attachment magnets 63 will allow the user to attach the medicine holder 100 to a surface while preparing an animal to receive an injection.

In use, a medicine vial containing temperature sensitive medicine is acquired, and the user selects the appropriate size internal insulated sleeve 41 that will snugly and securely fit around the medicine vial. The elastic cord 50 is removed from the bottom of the bottom section 30, which allows the top section 20 to be slid entirely out of the bottom section 30. This allows the user to slide the internally insulated sleeve 41 with the medicine bottle inside into the top section. The top cap 10 can be screwed onto the top section 20 to close off the closeable top 29. The top of the medicine vial can be slip up so that the top is aligned with the center hole 13 in the top cap, which allows the user access to the vial of medicine. The bottom disk 43 is slid into the bottom section 30 and pushed down to the inside bottom 39. The top section 20 is then slid into the open interior 34 of the bottom section and slid inwardly until the medicine bottle and the internal insulated sleeve 41 is pressed against the bottom disk 43. This fully insulates the medicine bottle. The elastic cord 50 can then be slid back around the bottom section 30 to hold the top section 20 in place. The combined top section 20 and bottom section can then be inserted into the outer sleeve 60. The medicine vial will now be insulated, and the user can access the medicine within the vial through the rubber vial stopper which will be accessible through the center hole 13 in the cap 10.

Figure 12:
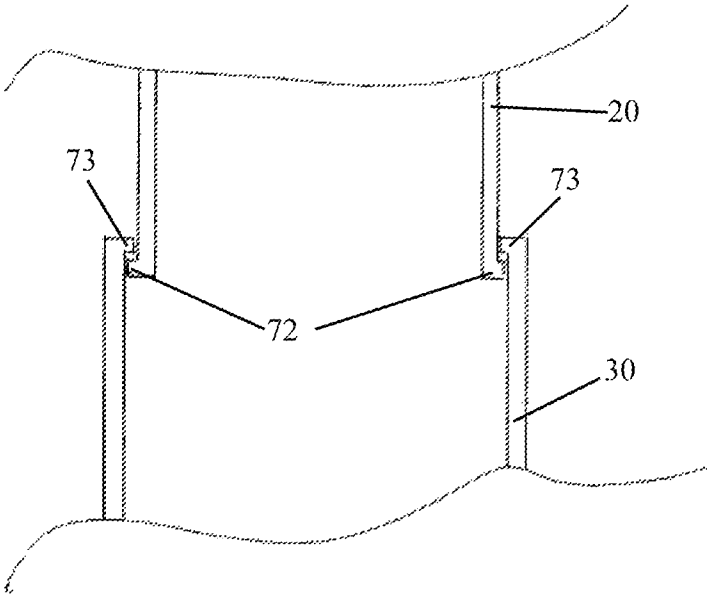
FIG. 12 is a detail cut-away view of the top and bottom retention lips.

In an alternate embodiment, shown in FIG. 12 (not to scale), there is an internal retention lip 73 at the top rim 37 of the inside wall 32 of the bottom section 30. The internal retention lip 73 runs the entire circumference of the inside wall 32 at the top rim 37 of the bottom section 30, as shown in FIG. 12. There is also a corresponding external retention lip 72 at the bottom rim 27 of the outside wall 22 of the top section 20. The external retention lip 72 runs the entire circumference of the outside wall 22 and is adjacent to the bottom rim 27. The internal retention lip 73 and external retention lip 72 are made of the same material as the top section 20 and bottom section 30, and will, in one embodiment, simply be molded from the same material. In the preferred embodiment the lips 72 and 73 will be 2 to 3 mm wide and 2-3 mm tall. The internal retention lip 73 and external retention lip 72 prevent the top section 20 from being easily and inadvertently pulled out of the bottom section 30 during use. Because the material of the top section 20 and bottom sections 30 are relatively soft and pliable plastic, the parts can be snapped together. The components can also be pulled apart with enough force, or by pressing in on the bottom of the top section 20 to reduce the circumference, but overall the paired retention lips 72 and 73 provide a detent to prevent inadvertent disassembly of the parts.

Figure 13:
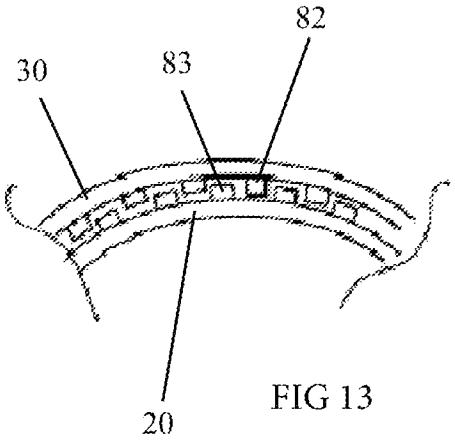
FIG. 13 is a cut away view of one embodiment with multiple twist prevention ridges.

In an alternate embodiment, shown in FIG. 13, there are longitudinal internal ridges 82 on the inside wall 32 of the bottom section 30. The longitudinal internal ridges 82 run the length of the inside wall 32 from the top rim 37 to the inside bottom 39. The internal ridges are 2 mm wide and tall and are spaced 2.5 mm apart. There are corresponding longitudinal external ridges 83 on the external wall 22 of the top section 20, which are also 2 mm tall and wide and spaced 2.5 mm apart. The internal ridges 82 and external ridges 83 correspond so that the external ridges 83 sit in the gap between the internal ridges 82, and visa versa. These paired ridges prevent the top section 20 from twisting as it is moved in and out of the bottom section 30. The paired ridges also minimizes the open space between top section 20 and the bottom section 30 to prevent heat loss. In one embodiment the paired ridges cover the entire inside wall 32 and external wall 22. In an alternate embodiment there are only a handful of paired ridges 82 and 83 on diametrical sides of the walls.

Figure 14:
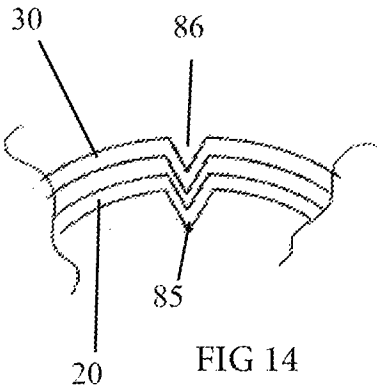
FIG. 14 is a cut away view of a second embodiment with paired twist prevention channels.

In an alternate embodiment, shown in FIG. 14, there is a "V" shaped channel 86 into the outside of the bottom section 30 which then extends inwardly from the inside wall 32. There is a corresponding "V" shaped channel 85 in the wall of the top section 30. The top section "V" shaped channel 85 is on both sides and runs downwardly from just below the bungee holes 25 to the bottom 27 of the top section. The bottom "V" shaped channel 86 is also on both sides of the bottom section 30, and fits into the top "V" shaped channel 85 to prevent the top section 20 from twisting as it moved into and out of the bottom section 30. In the preferred embodiment there are two top channels 85 that are diametrically opposed, and two bottom channels 86 that are diametrically opposed, such that each top channel 85 fits into each bottom channel. The elastic cord 50 sits in the "V" shaped channel 85 of the top section 20 and then in the "V" shaped channel 86 of the bottom section, which prevents it from being damaged or tangled.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. An adjustable insulated medicine holder to hold a vial of temperature sensitive liquid medicine, consisting of:

an adjustable container body having;

a bottom section having an opened top, enclosed bottom, and bottom open interior;

a top section having an opened bottom, a top open interior, and a closable top;

a cap with a central hole, said cap configured to close the closable top, wherein said vial is accessed through said central hole;

wherein said top section fits into said bottom open interior, and can move inwardly and outwardly in said bottom open interior to adjust the sized of a combined open interior space;

a disk of insulating material sized to fit within the bottom open interior and adjacent to said enclosed bottom;

an insulated sleeve disposed within said top open interior, said insulated sleeve having a central bottle opening therein configured to fit around and insulate said vial;

an elastic cord attached to the top section and the bottom section to allow the sections to be pulled apart and then return to an initial position;

wherein said vial of medicine is placed within said central bottle opening within said insulated sleeve, said insulated sleeve inserted into said top section open interior and said top section inserted into said bottom section open interior thereby insulating said vial.

2. The adjustable insulated medicine holder of claim 1 wherein said top section and said bottom section are tubular in shape.

3. The adjustable insulated medicine holder of claim 2 wherein said bottom section has an interior circumference and said top section has an exterior circumference, and wherein said top section exterior circumference is less than one millimeter smaller than said bottom section interior circumference.

4. The adjustable insulated medicine holder of claim 3 wherein said top section has in interior circumference and said insulated sleeve has an exterior circumference that is the same as said top section interior circumference such that said insulated sleeve fits snuggly within said top section.

5. The adjustable insulated medicine holder of claim 1 wherein said elastic cord can stretch to a maximum length, and wherein further said elastic cord is attached to said top section and is configured to stretch around the enclosed bottom of the bottom section, and wherein when said top section is pulled outwardly from said bottom section the elastic cord cannot stretch far enough to allow said top section to be removed from said bottom section.

6. The adjustable insulated medicine holder of claim 1 further including an outer sleeve made from insulating material, said outer sleeve having an open interior therein wherein said bottom section fits within said outer sleeve open interior.

7. The adjustable insulated medicine holder of claim 6 wherein said outer sleeve includes a loop holder attached thereto, said loop holder configured to hold a syringe for use with medicine contained within said vial.

8. The adjustable insulated medicine holder of claim 7 wherein said outer sleeve includes at least one attachment magnet attached thereto, said attachment magnet configured to allow said outer sleeve to be temporarily secured on a metal surface.

9. The adjustable insulated medicine holder of claim 2 wherein said top section open bottom has an exterior circumference and a top circumferential retention lip disposed thereon, and wherein said bottom section open top has an interior circumference and a bottom circumference retention lip disposed thereon; and wherein when said top section is inserted into said bottom section said bottom circumferential retention lip prevents said top circumferential retention lip from being removed from said bottom section, thereby preventing said top section from being easily withdrawn from said bottom section.

10. The adjustable insulated medicine holder of claim 2 wherein said top section has an external wall and wherein a multiplicity of top longitudinal ridges are disposed thereon with a space therebetween, and wherein said bottom section has an internal wall and wherein a multiplicity of bottom longitudinal ridges are disposed thereon with a space therebetween, and wherein further, when said top section is inserted into said bottom section said top longitudinal ridges fit into the space between said bottom longitudinal ridges, thereby preventing the top section from twisting within the bottom section.

11. The adjustable insulated medicine holder of claim 2 wherein said top section has an external wall and wherein there are two longitudinal channels disposed diametrically opposite each other on the external wall, and wherein said bottom section has an internal wall and wherein there are two longitudinal channels disposed diametrically opposite each other on the internal wall, and wherein further each of said top section longitudinal channels is sized and oriented to fit into each of said bottom section longitudinal channels to prevent said top section from twisting within said bottom section.

12. An insulated medicine holder to hold a vial of temperature sensitive liquid medicine, consisting of:

a tubular top section and a tubular bottom section wherein the top section is sized to fit snugly into said bottom section and wherein further said top section can slide inwardly into and outwardly out of said bottom section;

a flexible cord attached to the top section and the bottom section wherein said flexible cord allows the top section to be slide inwardly and outwardly within said bottom section then return to an original position, and wherein further said flexible cord has a defined length that prevents to top section from sliding out of the bottom section so that the two sections remained attached;

said top section has a closeable top with an externally threated top rim;

a cap with an internally threaded rim, wherein said internally threaded rim is sized and configured to attach to said top section externally threaded to rim to close said top section;

said cap has a center hole to allow access to the top of the medicine vial;

a tubular interior sleeve of insulating material sized and configured to fit fully inside said top section, and sized and configured to fit snugly around said medicine vial to fully insulate;

a disk of insulating material that fits on the inside bottom of said bottom section.

13. The insulated medicine bottle holder of claim 12 further consisting of an outer sleeve sized and configured to fit around said bottom section to provide additional insulation.

* * * * *